US006390330B2

(12) United States Patent
Runft

(10) Patent No.: US 6,390,330 B2
(45) Date of Patent: May 21, 2002

(54) APPARATUS FOR METERING AND DISPENSING POWDER INTO HARD GELATIN CAPSULES OR THE LIKE

(75) Inventor: Werner Runft, Winnenden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/757,619

(22) Filed: Jan. 11, 2001

(30) Foreign Application Priority Data

Jan. 13, 2000 (DE) ..... 100 01 068

(51) Int. Cl.[7] ..... B65B 1/38

(52) U.S. Cl. ..... 222/41; 222/25; 222/168.5; 141/71; 141/81; 141/146; 141/238; 141/240; 141/242

(58) Field of Search ..... 222/168, 168.5, 222/25, 41–44; 141/71, 81, 146, 238, 240, 242

(56) References Cited

U.S. PATENT DOCUMENTS 4,062,386 A * 12/1977 Zanasi ..... 141/258
4,635,688 A * 1/1987 Graffin ..... 141/1
5,240,049 A * 8/1993 Chiari ..... 141/81
5,626,171 A * 5/1997 Mirri ..... 141/152

* cited by examiner

*Primary Examiner*—J. Casimer Jacyna
(74) *Attorney, Agent, or Firm*—Ronald E. Greigg

(57) ABSTRACT

An apparatus for metering and dispensing powder into hard gelatin capsules or the like. The apparatus has a metering disk that rotates in advancing steps, with bores disposed in its base. The bores which cooperate with tamping plungers that move up and down. The tamping plungers are disposed on a common tamping plunger support and when inserted into the bores, compress the powder into compressed pellets. In order to detect breakage of the springs and in order to be able to make a statement as to the mass of the compressed pellets, means are provided which detect the spring path of the tamping plungers immediately preceding the ejection plungers.

13 Claims, 3 Drawing Sheets

APPARATUS FOR METERING AND DISPENSING POWDER INTO HARD GELATIN CAPSULES OR THE LIKE

PRIOR ART

The invention relates to an apparatus for metering and dispensing powder into hard gelatin capsules or the like as has been disclosed by DE 197 20 362 A1. In the known apparatus, the springs, which were previously coupled to the tamping plungers for the metering and compression of the powder in the bores of the metering disk, are replaced with pneumatically acting means. It is therefore possible to eliminate the danger of spring breakage and at the same time to minimize the conversion work required in a format change of the apparatus. Mention is also made of the fact that by means of pressure sensors for the pneumatic means, which are coupled to the control device of the apparatus, make it possible for there to be a monitoring/control of the tamping plungers.

However, a quantitative statement as to the powder quantities metered into the bores of the metering disk by the tamping plungers has not been possible up to this point with either the known apparatus with pneumatic means instead of the springs or with an apparatus that has springs for the tamping plungers.

ADVANTAGES OF THE INVENTION

The apparatus according to the invention for metering and dispensing powder into hard gelatin capsules or the like has the advantage over the prior art that it is possible to make a quantitative statement as to the weight of the compressed pellets formed in the bores of the metering disk. In a simple way, this permits a 100% weight control of the compressed pellets, which previously took place outside the apparatus by means of a weighing device, for example the closed hard gelatin capsules were weighed. With a 100% weight control of the hard gelatin capsules by means of the weighing device, the performance of the apparatus was limited or a number of weighing devices were required.

Other advantageous improvements of the apparatus according to the invention are disclosed herein. An embodiment set forth makes it possible, for example, to convert existing conventional tamping plungers that cooperate with mechanically acting springs. This embodiment permits both a weight control of each individual compressed pellet and also optionally permits a statement to be made as to the presence of possibly broken springs. A particularly simple format adaptation and adjustability of the apparatus are permitted. With this embodiment, the pneumatically acting means of the individual tamping plunger groups can be adjusted in order to permit a format or weight adaptation of the compressed pellets. Another embodiment permits a conversion of existing apparatuses with springs without having to insert pneumatic means.

BRIEF DESCRIPTION OF THE DRAWINGS

An exemplary embodiment of the invention is shown in the drawings and will be explained in detail in the subsequent description.

DESCRIPTION OF THE EXEMPLARY EMBODIMENTS

Figure 1:
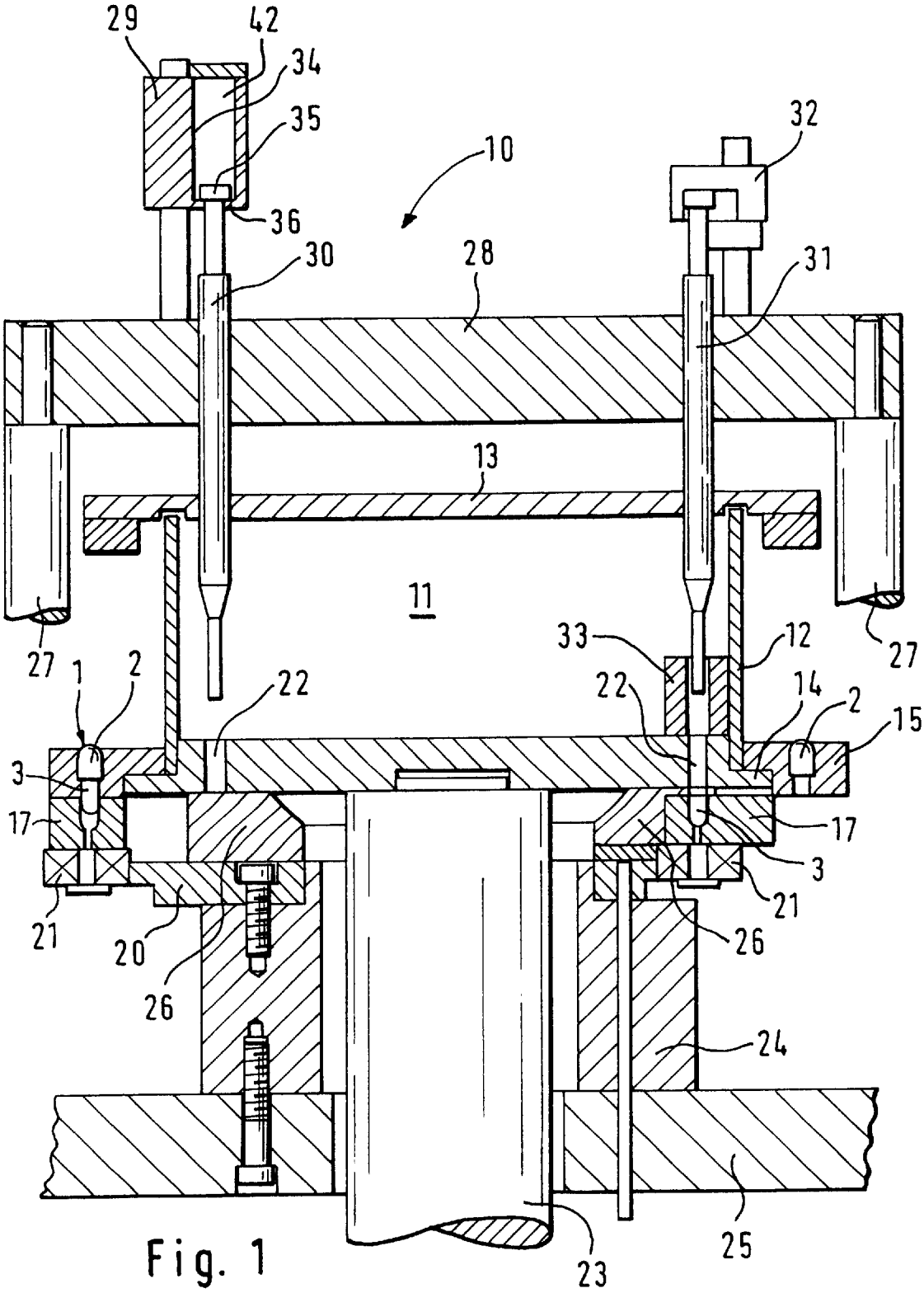
FIG. 1 is a longitudinal section through an apparatus for metering and dispensing powder into hard gelatin capsules or the like, FIG. 2 is a simplified top view of a metering disk.

The apparatus 10 for metering and dispensing powder into hard gelatin capsules 1 or the like shown in FIG. 1 has a filling material container 11. The filling material container 11 is constituted by a casing 12, a cover 13, and a metering disk 14. At the same level as the metering disk 14, the filling material container 11 is encompassed by a ring 15, which is used to hold capsule tops 2. Underneath the ring 15, segments 17 are provided, which are correspondingly embodied to hold capsule bottoms 3. The segments 17 are supported so that they can each pivot around a bolt, not shown, fastened in the ring 15 and during the rotation through a fixed curve 20 via a curve roller 21, are moved inward as needed, i.e. under the bores 22 of the metering disk 14, or outward, i.e. beyond the circumference of the ring 15. The metering disk 14 is fastened to a shaft 23 which is coupled to the drive mechanism of the apparatus 10 and rotates the metering disk 14 in advancing steps, by a respective angular amount each time. As can be seen from FIG. 2, the metering disk 14 has a total of four groups 18*a* to 18*d* offset from one another by 90 degrees, with five bores 22 each.

For the fastening of the curve 20, a second ring 24 is provided, which is in turn fastened to the table top 25 of the apparatus 10. Between the curve 20 and the metering disk 14, an intermediary ring 26 is provided, which can be pressed against the underside of the metering disk 14 in an intrinsically known manner by adjusting means not shown. This intermediary ring 26 is used to seal the bores 22 of the metering disk 14 in the vicinity of the powder metering.

As FIG. 1 also shows, a support 28, which can be moved up and down by means of columns 27 and is disposed above the filling material container 11, respectively executes a particular stroke. A number of tamping plunger supports 29, three tamping plunger supports 29 in the exemplary embodiment, are disposed on a graduated circle of the support 28 at uniform angular intervals, each of which has five tamping plungers 30 guided in it, which pass through the cover 13 of the filling material container 11 in corresponding bores. In addition, ejection plungers 31 are disposed on the support 28, which are connected to a retainer 32 disposed on the support 28 in such a way that they can move vertically. The ejection plungers 31 are encompassed inside the filling material container 11 by a powder deflecting body 33 that is intrinsically known and is not essential to the invention.

Figure 3:
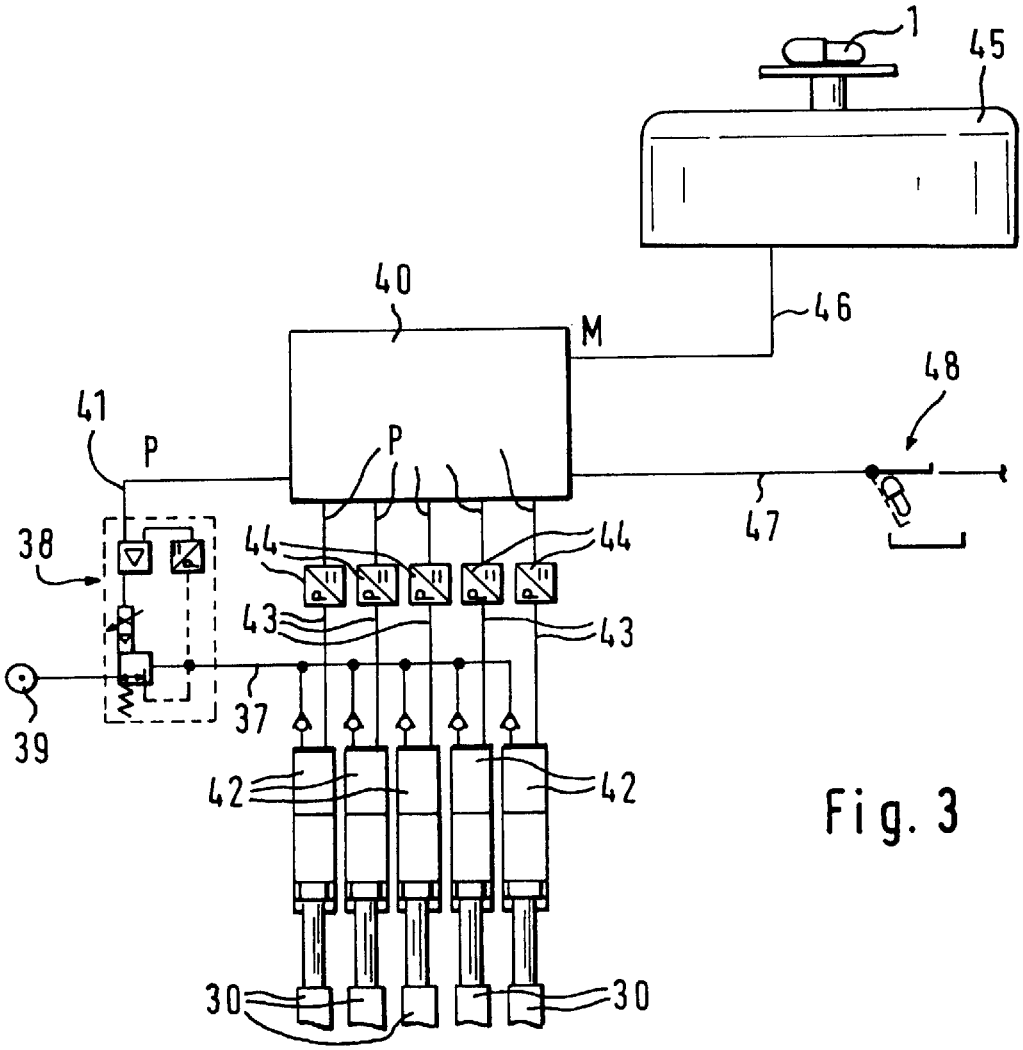
FIG. 3 is a schematic depiction for indicating the pneumatic triggering of a tamping plunger group.
Figure 4:
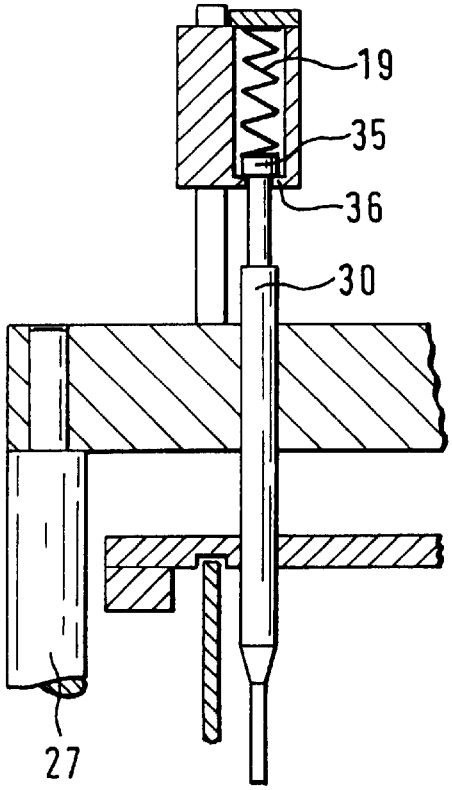
FIG. 4 is a section through a metering disk in the vicinity of a tamping plunger loaded by a spring.

What is essential to the invention is the disposition, embodiment, and function of the tamping plungers 30. In particular according to the first exemplary embodiment of the invention, at least the tamping plungers 30 immediately preceding the ejection plungers 31 when the metering disk 14 is rotated clockwise (FIG. 2) (i.e. in the position of the metering disk 14 shown, the tamping plungers 30 which are disposed above the group 18*d* of bores 22) are equipped with pneumatic means instead of the conventional springs 19 (FIG. 4). To that end, a bore 34 for each of the tamping plungers 30 is embodied in the tamping plunger support 29 associated with the tamping plungers 30. The upper ends of the tamping plungers 30, which are embodied as pistons 35, are guided in a sealed fashion in the bores 34 so that they can slide for a particular distance. A stop 36 limits the maximal stroke of the pistons 35 in the direction of the metering disk 14. The bores 34 of the tamping plunger support 29 have a common compressed air connection 37 (FIG. 3), which is connected to a compressed air source with the interposition of a pressure regulating circuit 38. The pressure regulating circuit 38 can be triggered by the control device 40 of the apparatus via a line 41. In particular, the control device 40 supplies a pressure reference value P(ref) as a preset to the pressure regulating circuit 38 via the line 41. Furthermore, the pressure chambers 42 of the bores 34 embodied above the pistons 35 are connected via lines 43 to pressure sensors 44, which supply the measured pressure values P(actual) to the control device 40 as input values. The control unit 40 is also coupled to a weighing device 45 which supplies the weighing result M(capsule) of a hard gelatin capsule 1 to the control device 40 as an input value via another line 46. Finally, an ejection device 48 can be triggered by means of a line 47 in order to be able to discharge individual hard gelatin capsules 1 from the apparatus 10.

In the above-described first exemplary embodiment of the invention, only the tamping plungers 30 immediately preceding the ejection plungers 31 (in the vicinity of the bore group 18*d*) are provided with the above-described pressure sensors 44. However, according to FIG. 4, the other two groups of tamping plungers 30 are equipped with conventional springs 19, which act via the tamping plunger support 29, for example on the top ends of the tamping plungers 30.

The above-described apparatus 10 functions as follows: In order to form the compressed pellets in the bores 22 from the powder disposed in the filling material container 11, the metering disk 14 is rotated in advancing clockwise steps under the tamping plungers 30 of a tamping plunger support 29. Then with a downward motion of the support 28, the tamping plungers 30 are inserted into the bores 22 of the metering disk 14, wherein the powder disposed in the bore 22 is compressed. During the compression or pressing of the powder, the intermediary ring 26 constitutes a counter support for the tamping plungers 30 and the powder. Then, the tamping plungers 30 are moved back out of the bores 22 of the metering disk 14, whereupon the metering disk 14 is rotated into the vicinity of the next tamping plunger support 29. After the last pressing action, the compressed pellets thus produced travel into the vicinity of the ejection plungers 31 where they are slid into the capsule bottoms 3 supplied by the segments 17. Then the capsule bottoms 3 are brought back together with the capsule tops 2.

The weight or mass of the compressed pellets formed in the bores 22 by the tamping plungers 30 and consequently the mass M(capsule) of the hard gelatin capsules 1 is determined on the one hand by the stroke of the tamping plungers 30 (produced by the stroke of the support 28), and is determined on the other hand by the spring ratio of the springs 19 cooperating with the tamping plungers 30 as well as the level of the pressure reference value P(ref). The greater the spring ratio of the springs 19 and the higher the pressure reference value P(ref), the less the tamping plungers 30 of the last tamping plunger group are deflected into the bores 22, i.e. the greater the density of the powder in the bores 22 and consequently the greater the mass of the compressed pellets as well.

It is now essential that by means of the pressure values P(actual) measured by the pressure sensors, which values correspond to the corresponding spring paths of the tamping plungers 30, for one thing, a statement can be made as to whether for example one of the springs 19 cooperating with the tamping plungers 30 is broken and for another, whether the mass of the compressed pellets in the bores 22 is within preset tolerances. This can be explained in that with correctly functioning springs 19 and a correct preset pressure reference value P(ref), the pressure value P(actual) and the spring path when a tamping plunger 30 is inserted into a bore 22 is increased by a particular amount or has a particular characteristic course. The level or course of the pressure value P(actual) consequently corresponds to the level or course of the spring path of a tamping plunger 30. When a spring 19 breaks, however, the powder disposed in a bore 22 is compressed much less or not at all by the corresponding tamping plunger 30 so that the last tamping plunger 30 coupled to the pressure sensor 44 is inserted more forcefully into the corresponding bore 22 since the powder has been compressed less beforehand. As a result, however, with its insertion, the measured pressure value P(actual) increases by only a slight amount and has a different characteristic curve. The breaking of a spring 19 can consequently be detected by virtue of the fact that the pressure value P(actual) is compared to a pressure value stored in the control device 40.

In addition, by means of the weighing device 45, the mass M(capsule) of a hard gelatin capsule 1 can be determined, which is associated with a particular progression of pressure values P(actual) detected in succession during the insertion of a tamping plunger 30 into a bore 22. If, for example, the determined mass M(capsule) is too high, then a lower pressure reference value P(ref) will be preset by the control device 40 so that the corresponding last tamping plunger 30 is inserted somewhat less into the bore 22 and consequently also introduces somewhat less powder. Consequently, it is possible to make a statement as to the mass of the compressed pellets by means of the pressure values P(actual) measured.

If the measured pressure value P(actual) of a compressed pellet and consequently the mass of the hard gelatin capsule 1 filled with the compressed pellet is outside predetermined tolerances, then the corresponding hard gelatin capsule 1 can be separated out by means of the ejection device 48.

With the above-described first exemplary embodiment, it is also possible in a format change to change the mass of the compressed pellets within certain limits by changing the pressure reference values P(actual), without having to replace the springs 19, which reduces the conversion times of the apparatus 10.

In a second exemplary embodiment of the invention, all of the tamping plungers 30 are equipped with pneumatic means, i.e. the tamping plungers 30 do not have any springs 19 according to FIG. 4. In accordance with the first exemplary embodiment, at least the tamping plungers 30 immediately preceding the ejection plungers 31 have pressure sensors 44 for detecting pressure values P(actual).

In order, in the second exemplary embodiment with a predetermined stroke of the support 28, to be able to produce different pressing powers of the tamping plungers 30 on the powder and consequently different densities and volumes of the compressed pellets, different pressure reference values P(ref) are provided. Depending on the pressure reference value P(ref) that is set, a corresponding air pressure acts on the tops of the pistons 35 so that a corresponding damping degree of the tamping plungers 30 is produced. This means that with a relatively high air pressure, the tamping plungers 30 are damped relatively little so that with a downward motion of the tamping plungers 30 into the bores 22, the powder is compressed relatively forcefully. This produces a relatively high density and mass of the compressed pellets. With a relatively low air pressure, the air disposed above the pistons 35 in the bores 34 can be compressed relatively forcefully with the compression by means of the compressed pellets. This means that a relatively low density and mass of the compressed pellets is produced.

Figure 5:
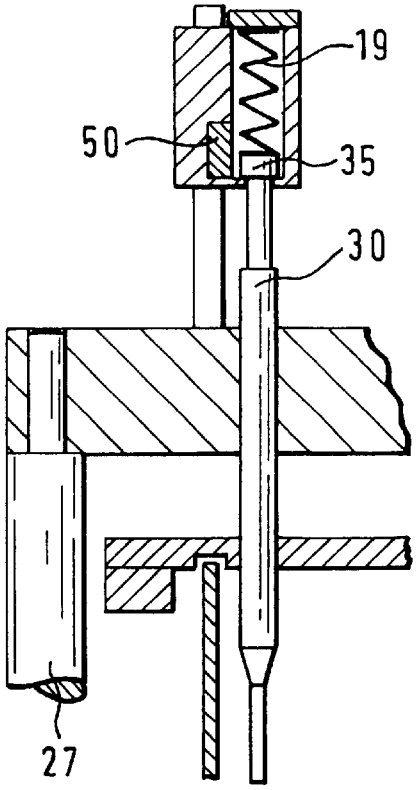
FIG. 5 is a section through a metering disk in the vicinity of a tamping plunger in a modified exemplary embodiment.

In the third exemplary embodiment of the invention, however, all of the tamping plungers 30 have springs 19 according to FIG. 4. However, the tamping plungers 30 immediately preceding the ejection plungers 31 are respectively equipped according to FIG. 5 with a path sensor 50 for each tamping plunger 30. This path sensor 50 coupled to the control device 40 of the apparatus 10 can, for example, be used as a strain gauge (DMS) or as an inductive sensor. It is only essential that the path sensor 50 detect the spring deflection characteristic curve of the tamping plungers 30 to a sufficiently precise degree when the tamping plungers 30 are inserted into the bores 22. This path characteristic curve consequently corresponds to the characteristic curve of the pressure values P(actual). With the third exemplary embodiment, both breakage of the springs 19 and incorrect meterings can be detected.

Figure 2:
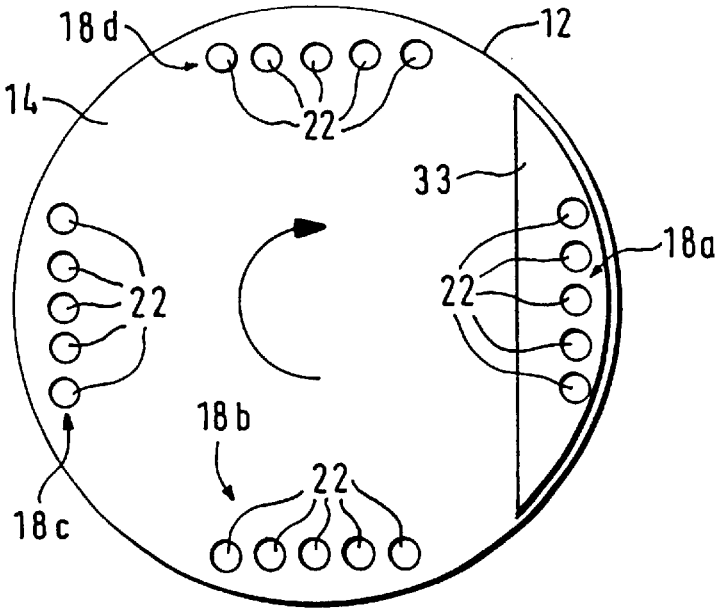

It should also be mentioned that the wiring example shown in FIG. 2 can be modified in numerous ways in order to permit, depending on the particular application, a more sensitive regulation of the set air pressure, for example, or a greater adjustment range.

In a modification of the first two exemplary embodiments, it is also conceivable to couple the tops of each of the tamping plungers to a membrane disposed in the tamping plunger support 29. On one side, this membrane is acted on by a particular air pressure so that the tamping plungers 30 are damped by the membranes in accordance with the air pressure.

The foregoing relates to preferred exemplary embodiments of the invention, it being understood that other variants and embodiments thereof are possible within the spirit and scope of the invention, the latter being defined by the appended claims.

I claim:

1. An apparatus (10) for metering and dispensing powder into hard gelatin capsules (1), comprising a filling material container (11) for the powder, a metering disk (14) with bores (22), which is disposed underneath the filling material container (11), the metering disk rotates in steps, and during a stop phase, comes into alignment with tamping plungers (30), the tamping plungers can be moved into and out of the bores (22) and when the tamping plungers are inserted into the bores (22), the tamping plungers dispense the powder into the bores (22) and compresses the powder, the tamping plungers (30) are disposed so that they are damped by spring means (19) or by pneumatically acting means (38, 39, 42) so that when the powder is compressed in the bores (22) the tamping plungers are deflected by a particular distance, and ejection plungers (31) following the tamping plungers (30), in which the ejection plungers transfer the compressed pellets previously formed in the bores (22) by the tamping plungers (30) into supplied capsule parts (3), at least the tamping plungers (30) immediately preceding the ejection plungers (31) have means (44; 50) for detecting the spring path of the tamping plungers (30) and that the means (44; 50) are coupled to a control device (40) which compares the detected spring paths to a spring path stored in the control device (40).

2. The apparatus according to claim 1, in which the tamping plungers (30) immediately preceding the ejection plungers (31) have pneumatically acting means (38, 39, 42) and that the tamping plungers (30) immediately preceding these tamping plungers (30) are coupled to springs (19).

3. The apparatus according to claim 2, in which the means for detecting the spring path of the tamping plungers (30) have pressure sensors (44).

4. The apparatus according to claim 3, in which in regard to the tamping plungers (30) cooperating with the pneumatically acting means (38, 42), the ends of the tamping plungers (30) remote from the bores (22) are embodied as pistons (35) that are guided in sliding fashion in cylinder bores (34) and are acted on by a compressed air source.

5. The apparatus according to claim 4, in which the cylinder bores (34) are connected by means of a common compressed air connection (37) coupled to the compressed air source (39).

6. The apparatus according to claim 2, in which in regard to the tamping plungers (30) cooperating with the pneumatically acting means (38, 42), the ends of the tamping plungers (30) remote from the bores (22) are embodied as pistons (35) that are guided in sliding fashion in cylinder bores (34) and are acted on by a compressed air source.

7. The apparatus according to claim 6, in which the cylinder bores (34) are connected by means of a common compressed air connection (37) coupled to the compressed air source (39).

8. The apparatus according to claim 1, in which all of the tamping plungers (30) are coupled to pneumatically acting means (38, 39, 42).

9. The apparatus according to claim 8, in which in regard to the tamping plungers (30) cooperating with the pneumatically acting means (38, 42), the ends of the tamping plungers (30) remote from the bores (22) are embodied as pistons (35) that are guided in sliding fashion in cylinder bores (34) and are acted on by a compressed air source.

10. The apparatus according to claim 9, in which the cylinder bores (34) are connected by means of a common compressed air connection (37) coupled to the compressed air source (39).

11. The apparatus according to claim 1, in which in regard to the tamping plungers (30) cooperating with the pneumatically acting means (38, 42), the ends of the tamping plungers (30) remote from the bores (22) are embodied as pistons (35) that are guided in sliding fashion in cylinder bores (34) and are acted on by a compressed air source.

12. The apparatus according to claim 11, in which the cylinder bores (34) are connected by means of a common compressed air connection (37) coupled to the compressed air source (39).

13. The apparatus according to claim 1, in which all of the tamping plungers (30) are coupled to spring means (19) and that the means for detecting the spring path of the tamping plungers (30) have path sensors (50).

* * * * *